US009407010B1

(12) United States Patent
Tonn et al.

(10) Patent No.: US 9,407,010 B1
(45) Date of Patent: Aug. 2, 2016

(54) SLOTTED ANTENNA WITH ANISOTROPIC COVERING

(71) Applicants: David A Tonn, Amston, CT (US); Susan M Safford, Jamestown, RI (US)

(72) Inventors: David A Tonn, Amston, CT (US); Susan M Safford, Jamestown, RI (US)

(73) Assignee: THE UNITED STATES OF AMERICA AS REPRESENTED BY THE SECRETARY OF THE NAVY, Washington, DC (US)

( * ) Notice: Subject to any disclaimer, the term of this patent is extended or adjusted under 35 U.S.C. 154(b) by 83 days.

(21) Appl. No.: 14/598,285

(22) Filed: Jan. 16, 2015

(51) Int. Cl.
*H01Q 13/22* (2006.01)
*H01Q 13/12* (2006.01)
*H01Q 1/42* (2006.01)

(52) U.S. Cl.
CPC . *H01Q 13/12* (2013.01); *H01Q 1/42* (2013.01)

(58) Field of Classification Search
CPC ..... H01Q 13/22
USPC ..... 343/700 MS, 767, 770
See application file for complete search history.

(56) References Cited

U.S. PATENT DOCUMENTS 2,818,565 A * 12/1957 Ajioka ..... H01Q 13/22 343/767
3,696,433 A * 10/1972 Killion ..... H01Q 13/10 333/237
3,978,485 A * 8/1976 Bonnaval ..... H01Q 13/22 343/767
6,759,985 B2 * 7/2004 Acher ..... H01Q 9/04 343/700 MS
6,784,848 B2 * 8/2004 Harris ..... H01Q 21/205 343/770
6,977,621 B2 * 12/2005 Kelly ..... H01Q 1/3275 343/711

* cited by examiner

*Primary Examiner* — Tho G Phan
(74) *Attorney, Agent, or Firm* — James M. Kasischke; Michael P. Stanley

(57) ABSTRACT

An antenna includes a tubular, conductive radiator having a longitudinal slot formed therein from a first end of the conductive radiator to a second end of the conductive radiator. An antenna feed can be joined to the conductive radiator adjacent to and across the slot. An anisotropic plate is positioned a uniform distance from the conductive radiator, centered above the slot. The plate extends beyond the length of the radiator and is electrically insulated therefrom. An anisotropic tube surrounds the plate and radiator. The anisotropic tube is electrically insulated from the plate and radiator. In use, this antenna gives enhanced bandwidth over ordinary slotted antennas. This can also be applied to preexisting slotted antennas for enhanced bandwidth.

15 Claims, 3 Drawing Sheets

SLOTTED ANTENNA WITH ANISOTROPIC COVERING

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention is directed to a slotted antenna having enhanced broadband characteristics.

(2) Description of the Prior Art

Slotted cylinder antennas are popular antennas for use in line of sight communications systems, especially where the carrier frequency exceeds 300 MHz. FIG. 1 provides a diagram of a prior art slotted cylinder antenna 10. Antenna 10 includes a metallic cylinder 12 having slot 14 cut into the wall of the cylinder 12. Cylinder 12 can be any thickness as long as skin effects are avoided. Slot 14 is parallel to an axis 16 of cylinder 12. In the antenna shown, slot 14 extends the entire length of the cylinder 12. The interior of the cylinder or cavity is typically filled with air but another dielectric material can be used. FIG. 1 shows an end-fed version of this antenna, but this antenna can also be center-fed. In the end-fed version, a transmission line 18 is provided through the cylinder 12 and connected across the slot 14 near one end of the slot 14. Transmission line 18 can be either a balanced line, such as a twisted pair, or an unbalanced line, such as a length of coaxial line (shown). In either case, the feeding transmission line 18 must have two conductors in order to connect across slot 14. The optimal frequency of this antenna is given by the length of the slot. The size of the cavity and the slot width govern bandwidth.

SUMMARY OF THE INVENTION

It is a first object of the present invention to provide a compact antenna capable of transmitting and receiving.

Another object is to provide such an antenna having broader band characteristics than heretofore known.

Yet another object is to provide enhancements to an existing slotted antenna.

Accordingly, there is provided an antenna that includes a tubular, conductive radiator having a longitudinal slot formed therein from a first end of the conductive radiator to a second end of the conductive radiator. An antenna feed can be joined to the conductive radiator adjacent to and across the slot. An anisotropic plate is positioned a uniform distance from the conductive radiator, centered above the slot. The plate extends beyond the length of the radiator and is electrically insulated therefrom. An anisotropic tube surrounds the plate and radiator. The anisotropic tube is electrically insulated from the plate and radiator. In use, this antenna gives enhanced bandwidth over ordinary slotted antennas. This can also be applied to preexisting slotted antennas for enhanced bandwidth.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
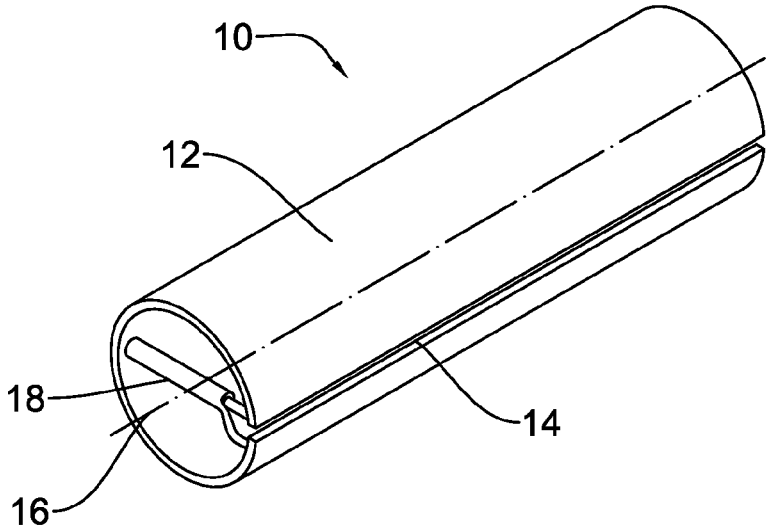
FIG. 1 (PRIOR ART)
FIG. 1 is a perspective view of a prior art antenna.
Figure 2:
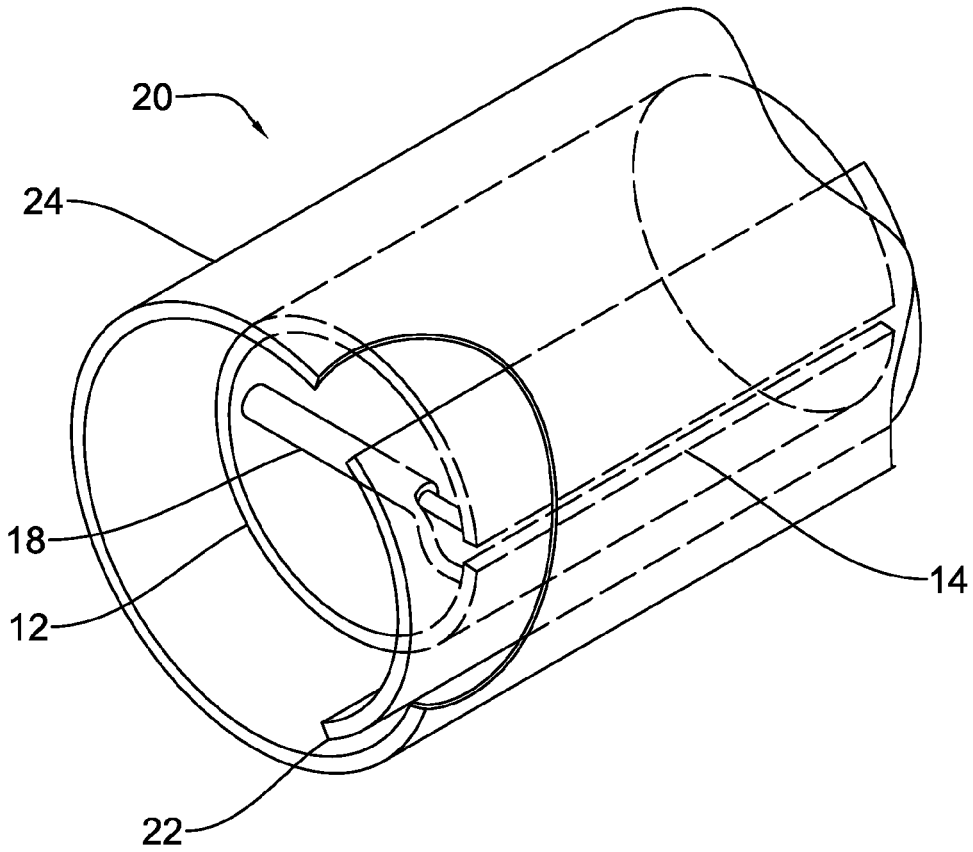
FIG. 2 is a cut away view of one embodiment of the antenna.

FIG. 2 provides a cut-away view of a slotted antenna 20 having a feed 18 joined to a slotted cylinder inner radiator 12. Radiator 12, slot 14 and feed 18 are substantially the same as shown in FIG. 1. Hidden portions of these objects are shown with dashed lines. Antenna 20 further includes an anisotropic cylinder portion 22 positioned apart from radiator 12 above slot 14. Portion 22 is coaxial with radiator 12 and extends angularly 60 degrees on either side of slot 14. Total angular extent of cylinder portion 22 is about 120 degrees. Testing determined that this was sufficient to capture emissions from radiator 12; however, this could have a smaller overlap. An anisotropic outer housing 24 is positioned outside of and surrounding cylinder portion 22 and radiator 12. Outer housing 24 is spaced apart from radiator 12 and portion 22 and coaxial with radiator 12 and portion 22. Outer housing 24 and portion 22 extend beyond the ends of radiator 12 by about 10% of the length of radiator 12 in order to utilize the electromagnetic fields that fringe around the ends of radiator 12. This was experimentally determined and could be optimized to a smaller or larger extension to completely enclose the field generated by radiator 12.

The interior regions of radiator 12, portion 22 and outer housing 24 can be filled with a dielectric material having a low dielectric constant. This can be a gas such as air or a solid such as syntactic foam. A liquid having this property could also be used.

Cylinder portion 22 and outer housing 24 are made from an anisotropic dielectric material. The dielectric tensor of both the cylinder portion 22 and outer housing 24 are engineered to impact the electric field that is generated in radiator 12. Due to the way in which this antenna is fed by the coaxial line, this electric field will be in the circumferential direction relative to the axis of the antenna. In the preferred embodiment, the material has a uniaxial dielectric tensor $|\in|$ in cylindrical coordinates in which $\in_{\rho\rho}=\in_{zz}=1$ and $\in_{\phi\phi}\sim 10$. (Off-diagonal elements in the tensor are negligibly close to zero.) Note that this tensor assumes a cylindrical coordinate system with the z axis coincident with the axis of the antenna. In another embodiment the tensor may be expressed in rectangular coordinates and be biaxial such that $\in_{xx}=\in_{yy}>1$ and $\in_{zz}\sim 1$.

The anisotropic dielectric material can be any such material known in the art having these characteristics. In one embodiment this material is a rectangular mesh having conductors oriented circumferentially and longitudinally printed on a dielectric backing. This material could also be a semiconductor material or a nanostructured material having these characteristics.

The presence of the two anisotropic layers, portion 22 and housing 24, increases the electrical length of the slot 14 above its first resonance and keeps the equivalent magnetic current density relatively stable, leading to improved impedance bandwidth.

Figure 3:
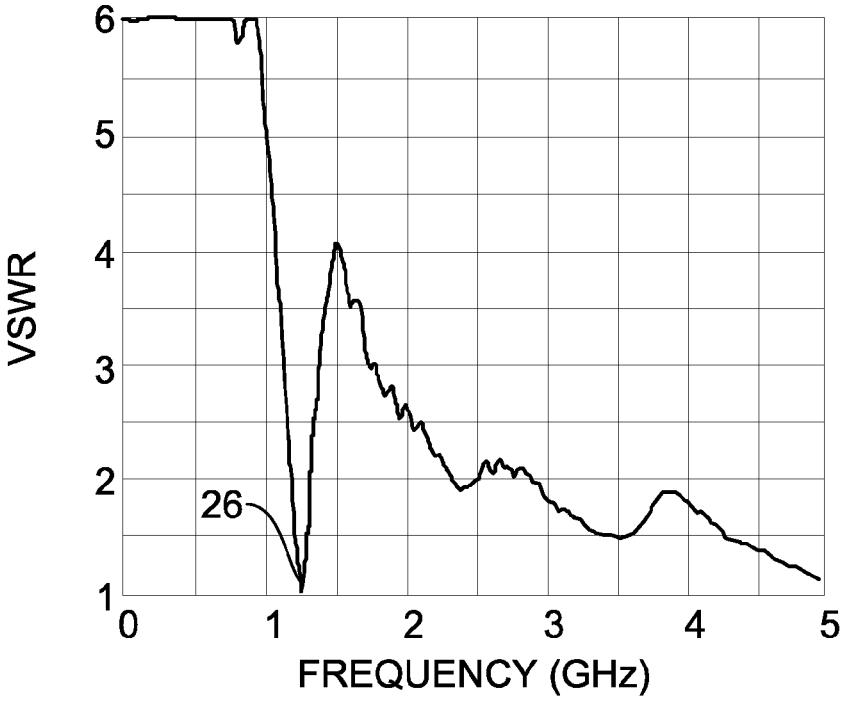
FIG. 3 is a graph of VSWR versus frequency for a prior art slotted antenna.
Figure 4:
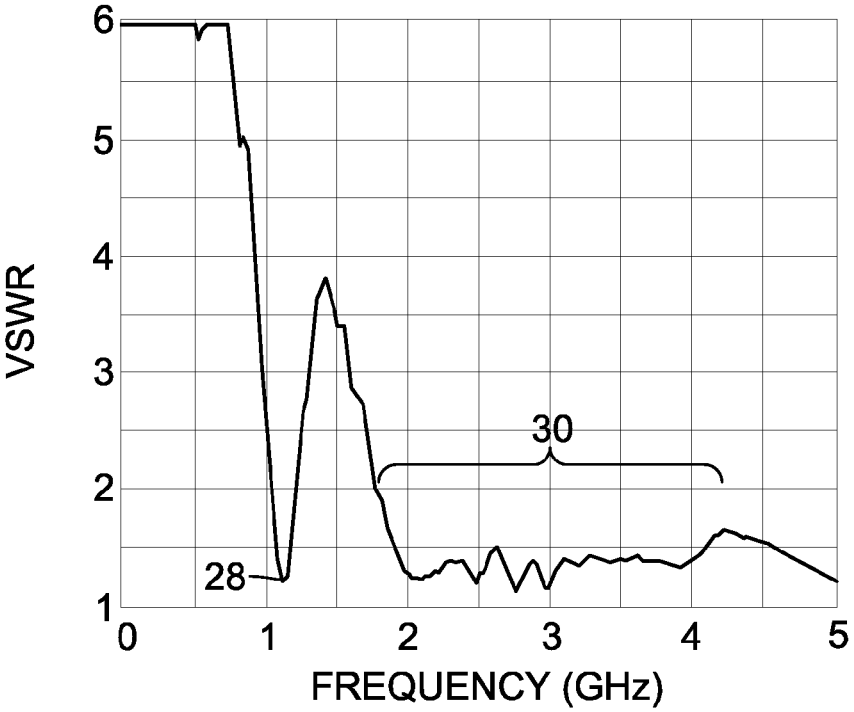
FIG. 4 is a graph of VSWR versus frequency for an antenna according to the current invention.

Measured plots of the voltage standing wave ratio (VSWR) for a prototype are shown in FIG. 3 and FIG. 4. FIG. 3 shows the VSWR for an antenna 10 without anisotropic portion 22 and cylinder 24. FIG. 4 is the VSWR plot for antenna 20 shown in FIG. 4. The VSWR of an antenna is typically used to define its bandwidth; normally a value less than 2:1 is considered the maximum VSWR in the passband. In FIG. 3, the valley indicated at 26 indicates a narrow passband at 1.25 GHz. The antenna has relatively high impedance in the frequencies above this frequency. The data shown in FIG. 4 indicates a first resonance in the valley shown at 28 centered about 1.125 GHz. A second passband is given by the broad region 30 above first resonance that runs from approximately 2.18 to 4.48 GHz. This is roughly one octave of bandwidth. This is more than is expected for a slotted cylinder antenna of this size.

Figure 5:
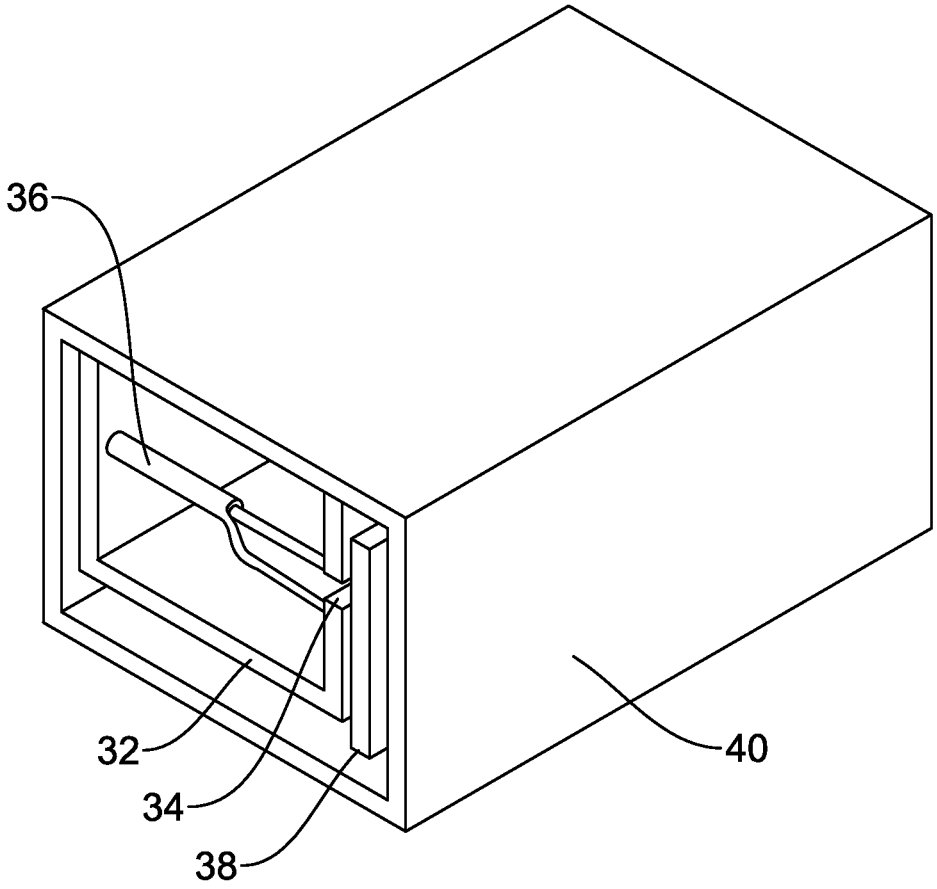
FIG. 5 is a perspective view of another embodiment of an antenna in accordance with the current invention.

FIG. 5 shows an alternate embodiment of slotted antenna utilizing a slot 34 in a rectangular inner radiator 32. Feed 36 is joined across slot 34. As before, inner radiator 32 is made from a metallic material having sufficient thickness to prevent skin effects. An anisotropic portion 38 is positioned adjacent to inner radiator 32 at slot 34. Portion 38 should be less than one wavelength of the operating frequency away from slot 34. As before, portion 38 should not be in electrical conduction with inner radiator 32. Portion 38 can be flat in conformance with the outer surface of inner radiator 32. For optimal performance, portion 38 should extend a sufficient distance on either side of slot 34 to capture electromagnetic radiation from slot 34. An outer anisotropic housing 40 is positioned outside of inner radiator 32 and portion 38. Outer housing 40 should be separated from inner radiator 32 by less than one wavelength at the operating frequency of the antenna. Portion 38 and outer housing 40 extend beyond the ends of inner radiator 32 sufficiently far to capture electromagnetic radiation emanating from the ends of inner radiator 32 in order to maximize efficiency.

Both portion 38 and outer housing 40 are made from an anisotropic dielectric material. This material must have a much greater resistivity in the direction across the face of portion 38 and housing 40, perpendicular to slot 34. This corresponds to the cylindrical coordinates given with reference to FIG. 2. Like the cylindrical embodiment of FIG. 2, rectangular embodiment of FIG. 5 utilizes portion 38 and outer housing 40 to give enhanced bandwidth; however, it is believed that this embodiment will have a less effective pattern than that of the cylindrical embodiment. Other geometries can be used of this antenna depending on the space available and the required beam pattern of the antenna.

This antenna has a greatly improved bandwidth, meaning that it can be used to support multiple communications services where several separate antennas might have been needed before. Given that the slotted cylinder antenna is one that is sometimes used in cellular communications towers as well as in digital television broadcast towers, a broadband version of this antenna might have significant applications in use on communications towers in order to host multiple services on a single antenna.

This antenna can be made by modifying existing slotted antennas by retrofitting these antennas with anisotropic portions and anisotropic outer radiators. This will improve the bandwidth of the existing antenna and allow greater flexibility.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An antenna capable of being joined to an antenna feed comprising:

a conductive radiator being substantially tubular and having a slot formed therein from a first end of the conductive radiator to a second end of the conductive radiator, the antenna feed being connectable to the tubular region adjacent to and across the slot;

an anisotropic plate positioned a uniform distance from a surface of said conductive radiator, centered above the slot, and extending from the first end of said conductive radiator to the second end of said conductive radiator, said anisotropic plate being electrically insulated from said conductive radiator; and an anisotropic tube positioned a uniform distance from a surface of said conductive radiator and a second uniform distance from said anisotropic plate, said anisotropic tube being electrically insulated from said conductive radiator and said anisotropic plate.

2. The apparatus of claim 1 wherein said anisotropic plate and anisotropic tube are made from a material having a substantially biaxial dielectric tensor in which $\in_{xx}=\in_{yy}>1$ and $\in_{zz}\sim 1$.

3. The apparatus of claim 1 wherein:

said conductive radiator is a cylinder having an axis;

said anisotropic plate is a portion of a cylinder coaxial with that of said conductive radiator and having a larger radius than said conductive radiator; and said anisotropic tube is a cylinder coaxial with that of said conductive radiator and having a second larger radius than said conductive radiator.

4. The apparatus of claim 3 wherein said anisotropic plate and anisotropic tube are made from a material having a substantially uniaxial dielectric tensor in which $\in_{\rho\rho}=\in_{zz}=1$ and $\in_{\phi\phi}\sim 10$.

5. The apparatus of claim 1 further comprising a solid dielectric material disposed in the interior of said conductive radiator.

6. The apparatus of claim 1 further comprising a solid dielectric material disposed between said conductive radiator and said anisotropic plate.

7. The apparatus of claim 1 further comprising a solid dielectric material disposed between said anisotropic plate and said anisotropic tube.

8. The apparatus of claim 1 wherein:

said anisotropic plate extends beyond the first and second ends of said conductive radiator by a sufficient distance to capture an electromagnetic field from said conductive radiator; and said anisotropic tube extends beyond the first and second ends of said conductive radiator by a sufficient distance to capture an electromagnetic field from said conductive radiator.

9. The apparatus of claim 1 wherein said anisotropic plate extends coextensively with said conductive radiator surface on either side of the slot a sufficient distance to capture a field emanating from the slot.

10. An apparatus for application to a preexisting slotted tubular antenna for increasing the bandwidth thereof comprising:

an anisotropic plate positionable a uniform distance from beyond a surface of the slotted tubular antenna, centered above the slot, and extending from a first end of the slotted tubular antenna to beyond a second end of the slotted tubular antenna, said anisotropic plate being electrically insulated from the slotted tubular antenna; and an anisotropic tube positioned a uniform distance from a surface of said anisotropic plate and a second uniform distance from the slotted tubular antenna, said anisotropic tube being electrically insulated from the slotted tubular antenna and said anisotropic plate.

11. The apparatus of claim 10 wherein said anisotropic plate and anisotropic tube are made from a material having a substantially biaxial dielectric tensor.

12. The apparatus of claim 10 further comprising a solid dielectric material disposed between the slotted tubular antenna and said anisotropic plate.

13. The apparatus of claim 10 further comprising a solid dielectric material disposed between said anisotropic plate and said anisotropic tube.

14. The apparatus of claim 10 wherein:

said anisotropic plate extends beyond the first and second ends of the slotted tubular antenna by a sufficient distance to capture an electromagnetic field from the slotted tubular antenna; and said anisotropic tube extends beyond the first and second ends of the slotted tubular antenna by a sufficient distance to capture an electromagnetic field from the slotted tubular antenna.

15. The apparatus of claim 10 wherein said anisotropic plate extends coextensively with the slotted tubular antenna surface on either side of the slot a sufficient distance to capture a field emanating from the slot.

* * * * *